US010016695B2

(12) United States Patent
Garcia et al.

(10) Patent No.: US 10,016,695 B2
(45) Date of Patent: Jul. 10, 2018

(54) PORTABLE PLAYMAT WITH INFLATABLE ELEMENTS

(71) Applicant: Q Holdings LLC, New York, NY (US)

(72) Inventors: Gregory Garcia, Yorktown Heights, NY (US); Julian R. Elias, Santo Domingo (DO)

(73) Assignee: QUIRKY IP LICENSING LLC, New York, NY (US)

( * ) Notice: Subject to any disclaimer, the term of this patent is extended or adjusted under 35 U.S.C. 154(b) by 0 days.

(21) Appl. No.: 14/120,344

(22) Filed: May 14, 2014

(65) Prior Publication Data

US 2014/0342633 A1 Nov. 20, 2014

Related U.S. Application Data

(60) Provisional application No. 61/823,385, filed on May 14, 2013.

(51) Int. Cl.
*A63H 3/06* (2006.01)
*A63H 33/42* (2006.01)
*A63H 18/00* (2006.01)

(52) U.S. Cl.
CPC ..... *A63H 33/42* (2013.01); *A63H 18/00* (2013.01)

(58) Field of Classification Search
CPC ..... A63H 3/06
USPC ..... 446/220
See application file for complete search history.

(56) References Cited

U.S. PATENT DOCUMENTS 2,727,242 A 12/1955 Otto
2,850,252 A * 9/1958 Ford ..... 244/114 R
3,091,454 A 5/1963 Sam
3,120,721 A * 2/1964 Bukatman et al. ..... 446/71
3,394,415 A 7/1968 Parker
D294,275 S 2/1988 Bergeron et al.
5,146,634 A * 9/1992 Hunt ..... 5/486
D335,060 S * 4/1993 Dial ..... D6/604
D375,984 S 11/1996 Burns
5,630,252 A * 5/1997 Wells ..... 24/16 PB
6,128,794 A * 10/2000 Pariseau
6,219,868 B1 * 4/2001 Wang ..... 5/709
(Continued)

FOREIGN PATENT DOCUMENTS

CA 2256835 A1 6/2000
CN 2696797 Y 5/2005
(Continued)

OTHER PUBLICATIONS

Mumzworld, Fisher-Price® Inflatable Mat—Luv U Zoo, downloaded from: http://www.mumzworld.com/en/fisher-pricer-inflatable-mat-luv-u-zoo-205646 on Jan. 8, 2017, 2 pgs.
Gumtree, ELC 7 Dinosaurs with Jurassic Inflatable Playmat, downloaded from: https://www.gumtree.com/p/other-baby-stuff/elc-7-dinosaurs-with-jurassic-inflatable-playmat/1004006513 on Jan. 8, 2017, 4 pgs.

*Primary Examiner* — John E Simms, Jr.
*Assistant Examiner* — Dolores Collins
(74) *Attorney, Agent, or Firm* — Hard IP LLC

(57) ABSTRACT

The present invention is a mat-like structure with three-dimensional, inflatable motifs attached thereto. The mat-like structure is comprised of a surface layer and base layer, with a system of air ducts positioned between the two layers. The air ducts receive air from an air pump or other source, and are connected to the three-dimensional, inflatable motifs. The mat-like structure may include electronic lights, sound-producing components and/or three-dimensional elements connected thereto.

24 Claims, 8 Drawing Sheets

(56) References Cited

U.S. PATENT DOCUMENTS

| | | | | |
|---|---|---|---|---|
| 6,739,876 | B2 * | 5/2004 | Ochi | 434/258 |
| 6,938,366 | B2 * | 9/2005 | Bober et al. | 40/610 |
| 7,003,908 | B2 * | 2/2006 | Bober et al. | 40/610 |
| 7,069,609 | B2 * | 7/2006 | Zheng | 5/654 |
| D552,909 | S | 10/2007 | McGrath et al. | |
| D596,436 | S | 7/2009 | Anderson | |
| 7,610,642 | B2 * | 11/2009 | Boyd | 5/712 |
| 7,645,219 | B1 * | 1/2010 | Buth | 482/142 |
| 8,024,830 | B2 * | 9/2011 | Wang et al. | 5/713 |
| 8,096,082 | B2 * | 1/2012 | Moran | 52/2.18 |
| 8,506,455 | B2 | 8/2013 | Cowett | |
| 2003/0136857 | A1 | 7/2003 | Han | |
| 2005/0048871 | A1 | 3/2005 | Brown | |
| 2005/0153630 | A1 | 7/2005 | Delaney et al. | |
| 2010/0199427 | A1 | 8/2010 | Anderson | |
| 2014/0259433 | A1 * | 9/2014 | Nunn et al. | 5/713 |

FOREIGN PATENT DOCUMENTS

| | | | |
|---|---|---|---|
| CN | 202777777 | U | 3/2013 |
| DE | 202013006179 | U1 * | 9/2013 |
| EP | 0963224 | A1 | 12/1999 |
| EP | 1051934 | A1 | 11/2000 |
| EP | 1114662 | A2 | 7/2001 |
| EP | 1334756 | A1 | 8/2003 |
| EP | 1779910 | A1 | 5/2007 |
| EP | 1930057 | A1 | 6/2008 |
| WO | 1994007388 | A1 | 4/1994 |
| WO | 9819762 | A1 | 5/1998 |
| WO | 2001068965 | A1 | 9/2001 |
| WO | 2004062758 | A2 | 7/2004 |
| WO | WO 2006017996 | A1 * | 2/2006 |
| WO | 2011044300 | A2 | 4/2011 |

* cited by examiner

PORTABLE PLAYMAT WITH INFLATABLE ELEMENTS

CROSS-REFERENCE TO RELATED APPLICATION

This non-provisional patent application claims priority from provisional patent Application No. 61/823,385, filed in the United States Patent and Trademark Office on May 14, 2013, the contents of which are hereby incorporated by reference in their entirety.

FIELD OF THE INVENTION

The invention relates to mat-like structures, particularly mats used for play and entertainment purposes.

BACKGROUND

There are currently known and marketed children's play-mats which depict different designs and layouts. However, none of the existing play-mats include three-dimensional, inflatable motifs which are attached to the mat itself and which are connected to a system of air ducts, wherein the air ducts all branch out from one common point at which air is introduced to the system.

SUMMARY

The current invention is a mat-like structure to which at least one three-dimensional, inflatable motif is attached. Associated with the structure are air ducts which connect the motif(s) to an air pump so that the motif(s) may be inflated.

DETAILED DESCRIPTION

The current invention is a flat, mat-like structure with at least two layers, a surface layer 10 and a base layer 12. In a preferred embodiment, air ducts 16 are positioned between the base layer 12 and surface layer 10. The arrangement of the air ducts 16 may vary from one embodiment to another. In one embodiment they may have a grid-like arrangement. In another, they may be arbitrarily positioned.

Figure 1:
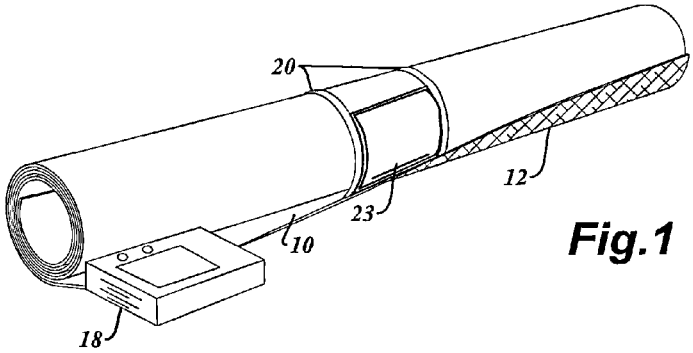
FIG. 1 is a perspective view of the play-mat in a rolled-up position.
Figure 2:
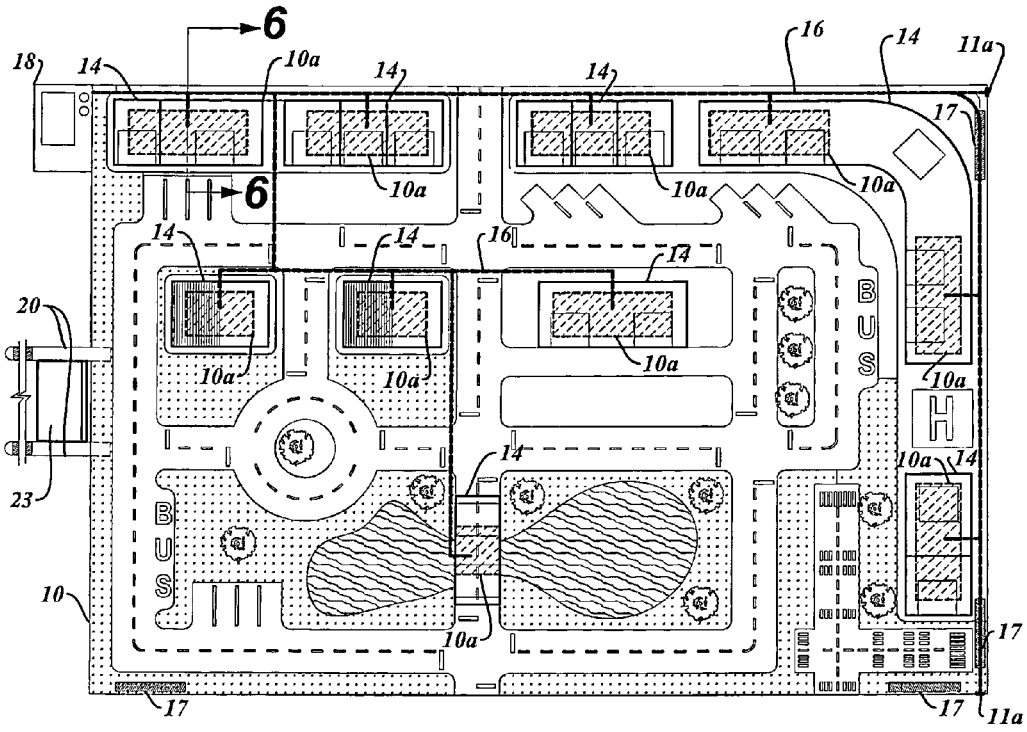
FIG. 2 is a plan view of a play-mat.
Figure 3:
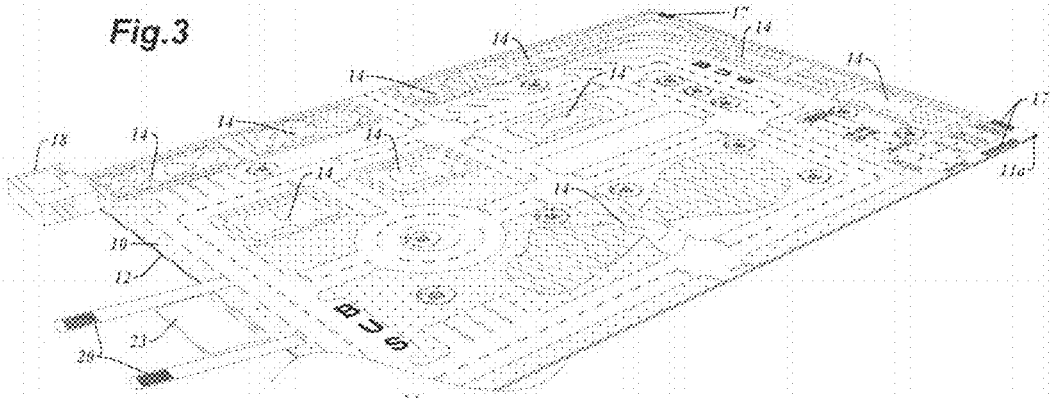
FIG. 3 is a perspective view of the play-mat with the three-dimensional, inflatable motifs in a deflated state.
Figure 4:
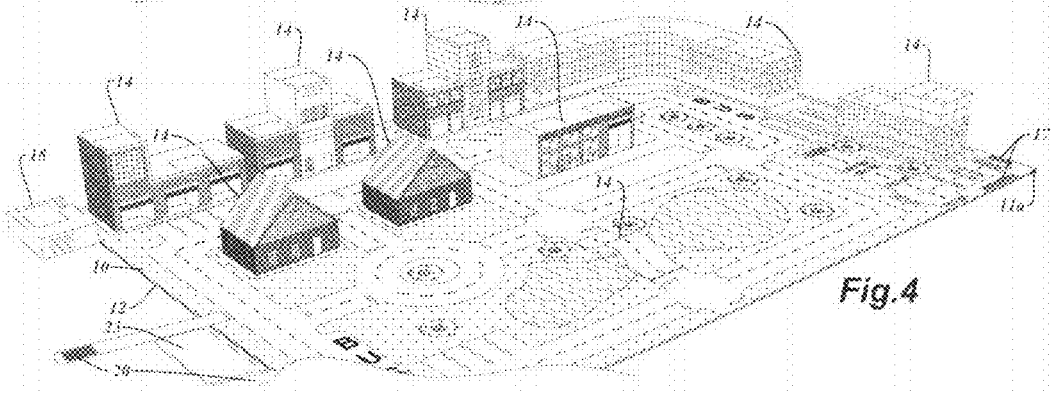
FIG. 4 is a perspective view of the play-mat with the three-dimensional, inflatable motifs in an inflated state.
Figure 5:
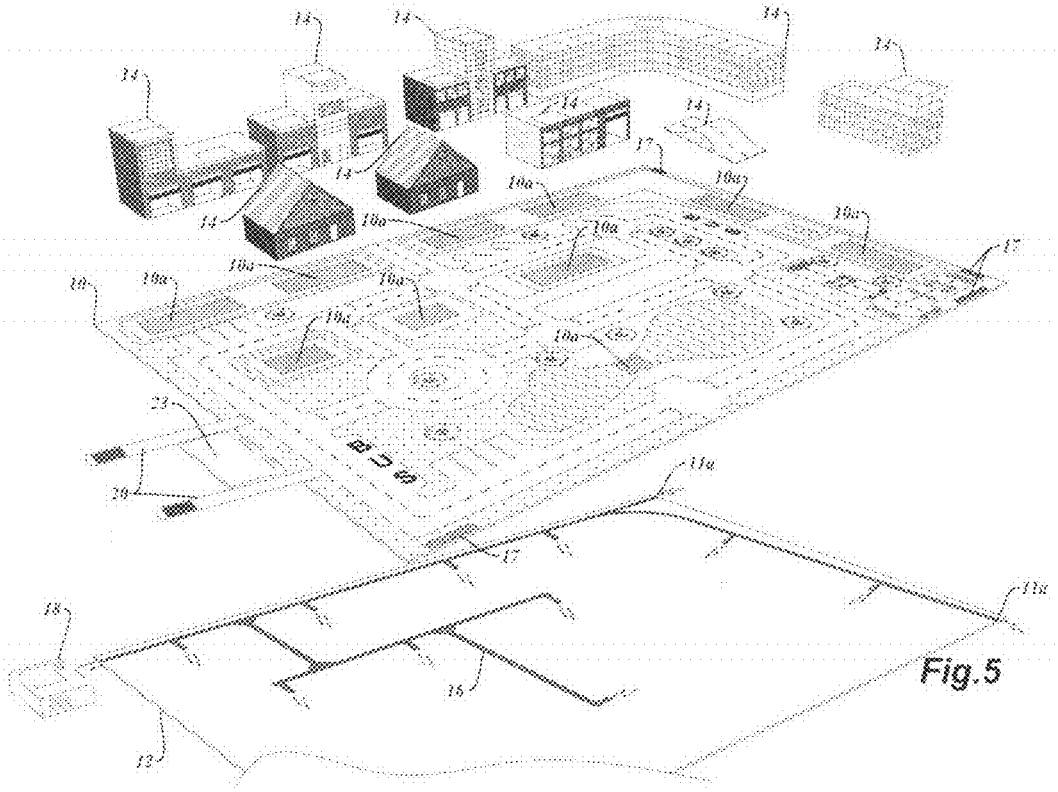
FIG. 5 is a perspective view of the play-mat with the different layers disassembled.
Figure 6:
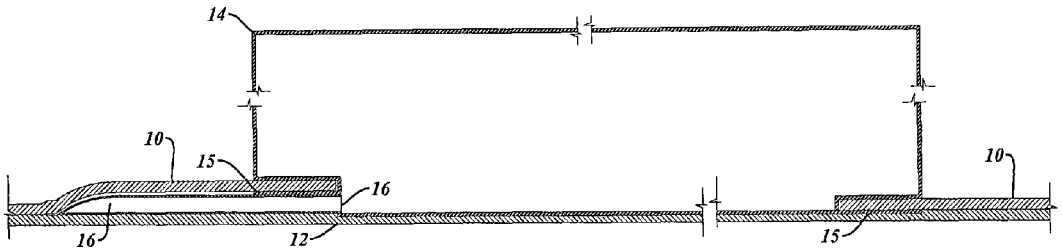
FIG. 6 is a cross-sectional view of an embodiment of the play-mat wherein the three-dimensional, inflatable motif is attached to the structure by way of flanges secured between the surface and base layers.
Figure 7:
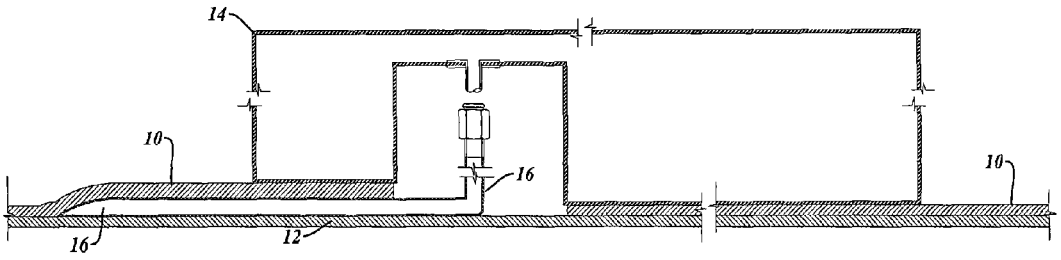
FIG. 7 is a cross-sectional view of an embodiment of the play-mat wherein the three-dimensional, inflatable motif is attached to the surface layer of the structure.
Figure 8:
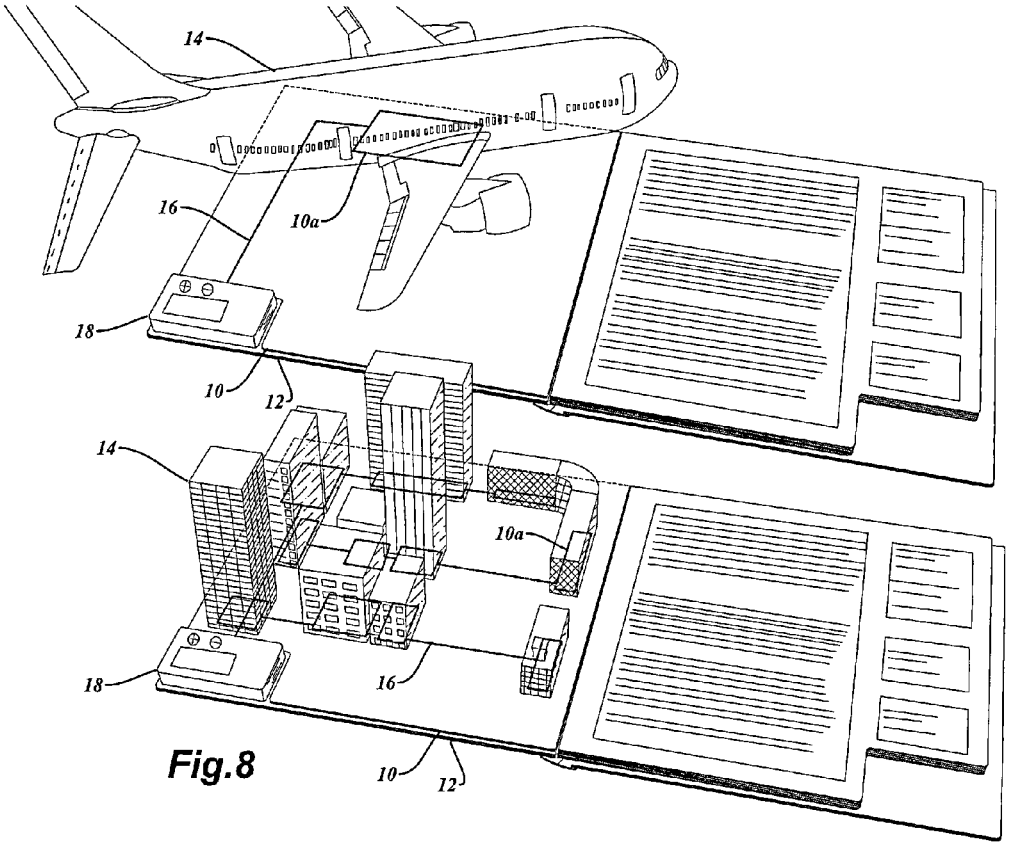
FIG. 8 shows alternative embodiments of how the invention could be used in the context of books.
Figure 9:
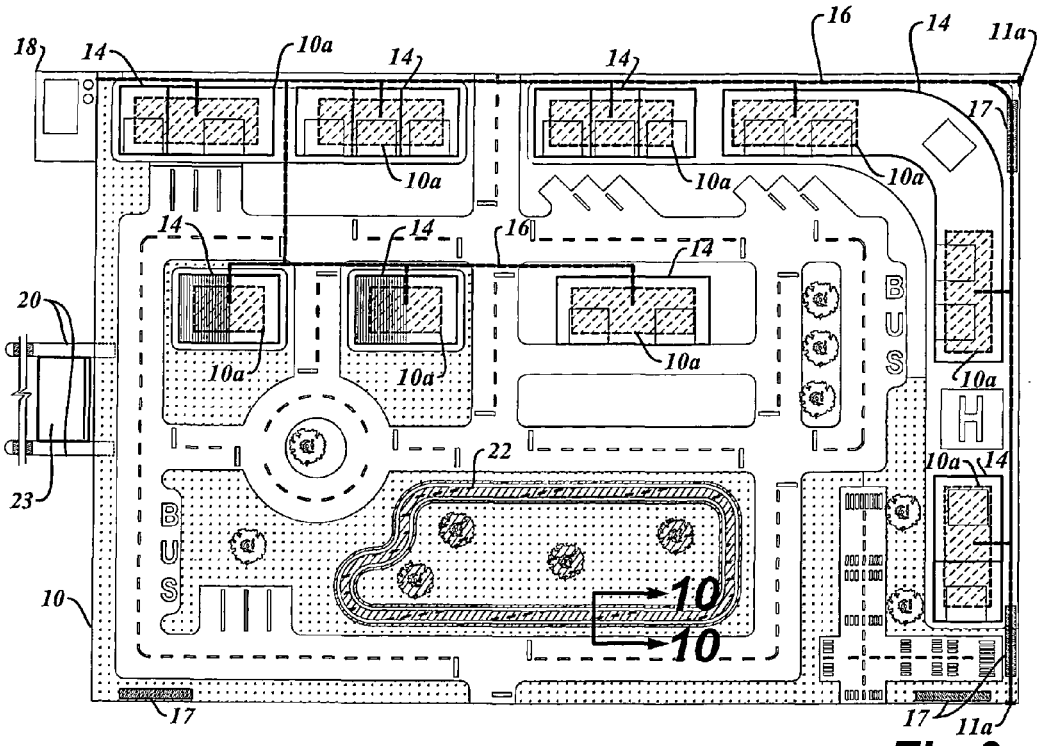
FIG. 9 is a plan view of a play-mat with a train track incorporated therein.
Figure 10:
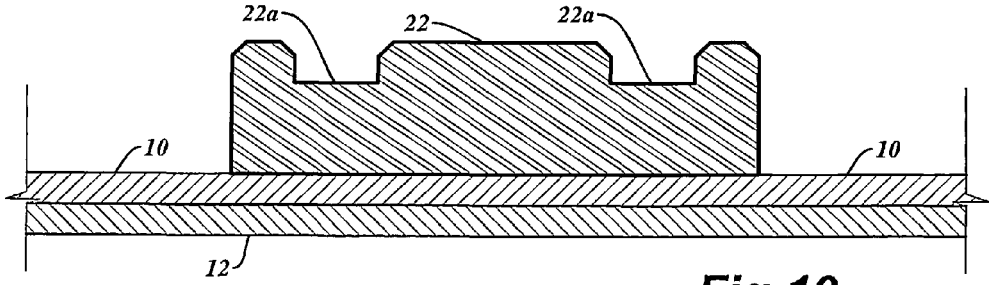
FIG. 10 is a cross-sectional view of the train track feature of the playmat.

There are inflatable, three-dimensional motifs 14 attached, either removably or permanently, to the mat-like structure. In one embodiment, the inflatable, three-dimensional motifs 14 have flanges 15 on their base which are positioned between the surface layer 10 and base layer 12, as shown in FIG. 6. The flanges 15 may be permanently secured in place using an adhesive or other suitable means. Alternatively, the flanges 15 may be removably attached to allow for interchangeability of the inflatable, three-dimensional motifs 14. In such an embodiment, the flanges 15 could be secured between the surface layer 10 and base layer 12 using snaps, a hook and loop, Velcro, or another suitable connection. In yet another embodiment, the inflatable, three-dimensional motif 14 can be attached (removably or permanently) to the surface layer 10, as shown in FIG. 7.

The surface layer 10 contains openings 10*a* which allow the three-dimensional motifs 14 to receive air from the air ducts 16. The three-dimensional, inflatable motifs 14 may be connected either removably or permanently to the air ducts 16. In the case that the inflatable, three-dimensional motifs 14 are connected permanently to the mat-like structure, the air ducts 16 may be directly connected to the three-dimensional motifs 14 in such a way that the air flows freely between the two. Alternatively, the connection between the three-dimensional, inflatable motif 14 and the air ducts 16 may be made using means generally known in the industry for making such a connection, such as male-female connectors. The ends of the air ducts 16 may have, a cap, plug, or check valve connected thereto. Accordingly, the three-dimensional, inflatable motifs 14 have a suitable means for connecting to the end of the air ducts 16.

The air ducts 16 branch out from a single point at which air is introduced to the system. Air may be introduced into the system manually (human respiration) or by use of an air pump 18. The air pump 18 may be battery operated, an alternating current pump, a manual pump, or a functional equivalent. The air pump 18 may be equipped with a power switch, an inflate button, a deflate button, and/or an air pressure sensor. The air pressure sensor will deactivate the air pump 18 when adequate pressure is reached, and will function on stand-by to activate the pump should the air pressure in the system drop too low. In one embodiment the air pump 18 is attached to an edge of the mat-like structure.

In one embodiment, the mat-like structure is a play-mat. In such an embodiment, the surface layer 10 is made of a nylon carpet or other suitable material. The base layer 12 can be made of a durable skid-proof material such as latex gel. The exterior of the surface layer 10 (the side opposite the side adjacent to the air ducts 16) may be decorated with a theme or scene, such as an aerial view of a town or park. The three-dimensional motifs 14 may be designed and positioned to complement the design of the surface layer 10.

There may also be electric powered lights and sound-producing elements added to the structure. In addition, there may be other three-dimensional elements, such as train tracks 22 suitable for a toy train, attached to the surface layer 10. The train tracks 22 may have grooves 22*a* made therein to guide the train wheels. The three-dimensional elements may be either permanently or removably attached to the surface layer 10. If the three-dimensional elements are removably attached to the surface layer, such connection may be made using snaps, Velcro or other suitable means.

In a preferred embodiment, all the components of the structure, as well as items attached thereto, are made of a material such that the mat may be either rolled-up or folded-up for easy storage and transport. Along one edge of the mat there are straps 20 which may be tied together, or other known means, such as velcro, for securing the mat in the rolled-up position. The mat may also include means for securing it in a folded-up position, including but not limited to clasps, buttons, hook and loop, Velcro, and string or fabric ties. The mat may also have a pouch 23 attached thereto.

In an alternative embodiment, the invention disclosed herein may be used for purposes of creating architectural scale models. In such an embodiment, the surface layer 10 shows the site plan and the inflatable, three-dimensional motifs represent the buildings or other physical structures.

Similarly, the invention disclosed herein could be applied on a smaller scale to books, where certain pages of the book are reinforced so that they are comprised of a base layer 12 and surface layer 10, with the air ducts 16 between them. The book can include a single three-dimensional, inflatable motif 14 or multiple motifs 14. As in the other embodiments, the air ducts 16 would be attached at one and to the motifs 14 and on the other end to the air pump 18.

Figure 11:
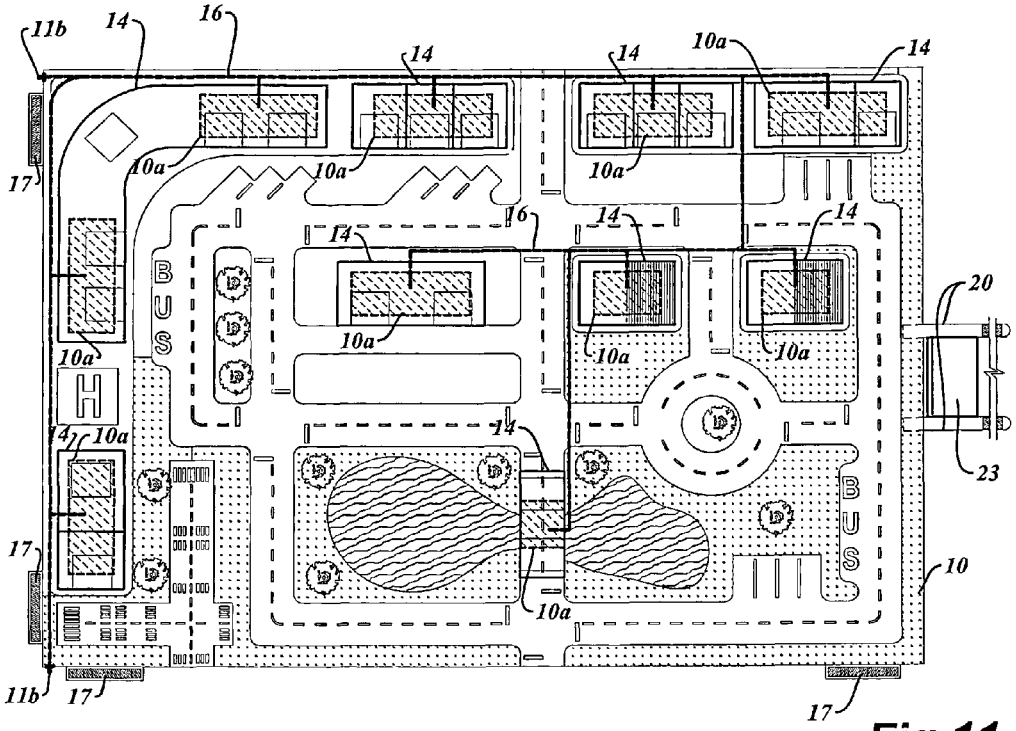
FIG. 11 is a plan view of an add-on mat-like structure.

The mat-like structure may also be connected to one or more add-on mat-like structures. An embodiment of an add-on mat-like structure is shown in FIG. 11. The add-on mat-like structure is very similar to the mat-like structure described above. It consists of a surface layer 10, a base layer 12, with air ducts 16 positioned between the two layers, and three-dimensional, inflatable motifs 14. The surface layer 10 contains openings 10*a* which allow three-dimensional motifs 14 to receive air from the air ducts 16. The three-dimensional motifs 14 may be connected to the structure and the air ducts 16 in any of the ways disclosed above.

To allow for connection between the mat-like structure and the add-on mat-like structure, the air ducts 16 of the mat-like structure run to the edge thereof at at least one point and include a female-connector 11*a* at the end thereof; the air ducts 16 of the add-on mat-like structure run to the edge thereof at at least one point and include a male-connector 11*b* on the end thereof. The female-connector 11*a* of the air ducts 16 of the mat-like structure and the male-connector 11*b* of the air ducts 16 of the add-on mat-like structure allow the air ducts 16 of the two structures to be connected and run off of the air pump 18 of the mat-like structure. The mat-like structure and the add-on mat-like structure may also include velcro strips 17 or other equivalent means for connecting the two.

In another alternative embodiment, the surface layer 10 would have grooves, or channels, made in the side adjacent to the base layer 12. These grooves would be an alternate embodiment of the air ducts 16. Similar to the previously disclosed embodiments, these grooves branch out from a single point at which air is introduced to the system via an air pump 18 or otherwise. The inflatable, three-dimensional motifs 14 would connect to the grooves at openings 10*a* in the surface layer 10.

Figure 12:
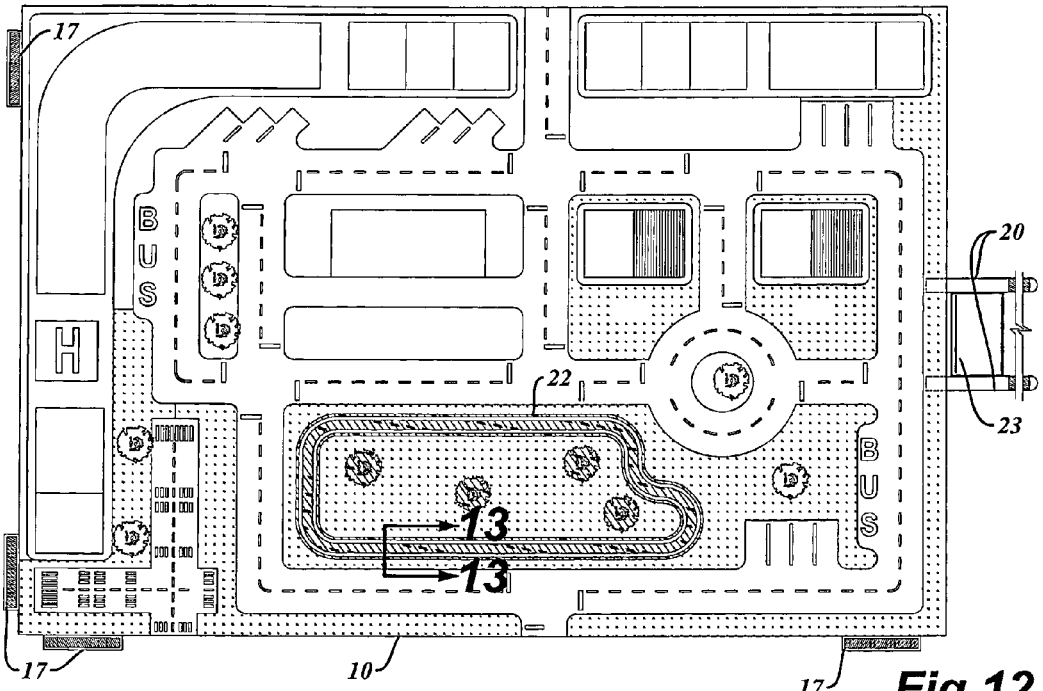
FIG. 12 is a plan view of an embodiment of the play-mat consisting of a surface layer and a train track feature connected thereto.
Figure 13:
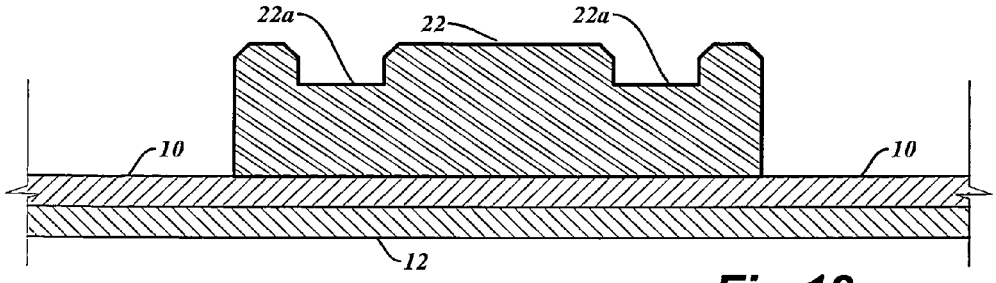
FIG. 13 is a cross-section view of an embodiment of the play-mat consisting of a surface layer and a train track feature connected thereto.

In yet another embodiment, the mat-like structure consists only of a surface layer 10 and base layer 12 with train tracks 22 suitable for a toy train attached thereto (see FIGS. 12, 13). The train tracks 10 may have grooves 22*a* made therein to guide the train wheels. In such an embodiment all the components of the structure are made of a flexible material such that they may be rolled up and easily transported. As in other embodiments, the mat-like structure may include straps 20 which may be tied together, or other known means, such as velcro, for securing the mat in the rolled-up position. The mat may also include means for securing it in a folded-up position, including but not limited to clasps, buttons, velcro, and string or fabric ties. The mat may also have a pouch 23 attached thereto.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

The invention claimed is:

1. A mat-like structure comprising:

a plurality of layers comprising:

a surface layer with openings made therein; and a base layer;

wherein at least one of the plurality of layers is flat;

a plurality of air ducts positioned between the surface layer and the base layer;

a plurality of three-dimensional, inflatable motifs connected to the plurality of air ducts at the openings in the surface layer, wherein at least one of plurality of three-dimensional, inflatable motifs, when inflated, extends outwards in a direction perpendicular to the least one of the plurality of layers that is flat; and an air pump attached to the plurality of air ducts.

2. The mat-like structure of claim 1 wherein the three-dimensional, inflatable motifs comprise flanges which are positioned between the surface layer and the base layer, wherein the flanges secure the three-dimensional, inflatable motifs between the surface layer and the base layer.

3. The mat-like structure of claim 2 wherein the flanges of the three-dimensional, inflatable motifs are permanently secured between the surface layer and the base layer.

4. The mat-like structure of claim 2 wherein the flanges of the three-dimensional, inflatable motifs are removably secured between the surface layer and the base layer.

5. The mat-like structure of claim 2 wherein the plurality of air ducts originate and branch out from one common point and the air pump is attached to the mat-like structure at the one common point from which the plurality of air ducts originate.

6. The mat-like structure of claim 5 wherein the air pump comprises an air pressure sensor which is programmed to activate or deactivate the air pump depending on a pressure reading.

7. The mat-like structure of claim 5 wherein components of the mat-like structure are made of a flexible material.

8. The mat-like structure of claim 7 further comprising straps of a sufficient length to secure the mat-like structure in a rolled-up position.

9. The mat-like structure of claim 5 further comprising electric powered lights.

10. The mat-like structure of claim 5 further comprising sound producing components.

11. The mat-like structure of claim 5 further comprising additional three-dimensional elements attached to the surface layer.

12. The mat-like structure of claim 5 wherein the plurality of air ducts run to edges of the mat-like structure at at least one point, wherein the mat-like structure comprises a female connector at a first end thereof, the mat-like structure further comprising:

an add-on mat-like structure comprising:

a second plurality of layers comprising:

a second surface layer with second openings made therein;

a second base layer;

wherein at least one of the second plurality of layers is flat;

a second plurality of air ducts positioned between the second surface layer and the second base layer;

a second plurality of three-dimensional, inflatable motifs comprising second flanges which are positioned between the second surface layer and the second base layer, and the second plurality of three-dimensional, inflatable motifs are connected to the second plurality of air ducts at the second openings in the second surface layer, wherein at least one of the second plurality of three-dimensional, inflatable motifs, when inflated, extends outwards in a direction perpendicular to the at least one of the second plurality of layers that is flat, wherein the second plurality of air ducts run to edges of the add-on mat-like structure at at least a second point wherein the add-on mat-like structure comprises a male connector at a second end thereof; wherein the mat-like structure and add-on mat-like structure are attached by the female connector and the male connector.

13. The mat-like structure of claim 5 further comprising a pouch attached thereto.

14. The mat-like structure of claim 1 wherein the three-dimensional, inflatable motifs are attached to the surface layer.

15. The mat-like structure of claim 14 wherein the three-dimensional, inflatable motifs are permanently attached to the surface layer.

16. The mat-like structure of claim 14 wherein the three-dimensional, inflatable motifs are removably attached to the surface layer.

17. The mat-like structure of claim 14 wherein the plurality of air ducts originate and branch out from one common point and the air pump is attached to the mat-like structure at the one common point from which the plurality of air ducts originate.

18. The mat-like structure of claim 17 wherein the air pump comprises an air pressure sensor programmed to activate or deactivate the air pump depending on a pressure reading.

19. The mat-like structure of claim 17 wherein components of the mat-like structure are made of a flexible material.

20. The mat-like structure of claim 19 further comprising straps of a sufficient length to secure the mat-like structure in a rolled-up position.

21. The mat-like structure of claim 17 further comprising additional three-dimensional elements attached to the surface layer.

22. The mat-like structure of claim 1 wherein the plurality of air ducts are formed by grooves made in the surface layer, wherein the grooves all originate from one common point, and the air pump is attached to the grooves at the one common point from which they originate.

23. A mat-like structure comprising:

a plurality of layers comprising:

a surface layer with openings made therein;

a base layer;

wherein at least one of the plurality of layers is flat;

a plurality of air ducts positioned between the surface layer and the base layer;

a plurality of three-dimensional, inflatable motifs with flanges, the flanges positioned between the surface layer and the base layer, wherein the flanges secure the three-dimensional, inflatable motifs between the surface layer and the base layer, the plurality three-dimensional, inflatable motifs connected to the plurality of air ducts at the openings in the surface layer, wherein the plurality of air ducts all branch out from one common point; and a connection device to allow for introduction of air to the plurality of air ducts at the one common point from which the air ducts originate.

24. A mat-like structure comprising:

a plurality of layers comprising:

a surface layer with openings made therein; and a base layer;

wherein at least one of the plurality of layers is flat;

a plurality of air ducts positioned between the surface layer and the base layer;

a plurality of three-dimensional, inflatable motifs connected to plurality of air ducts at the openings in the surface layer, wherein at least one of plurality of three-dimensional, inflatable motifs, when inflated, extends outwards in a direction perpendicular to the least one of the plurality of layers that is flat; and a plurality of train tracks configured to couple to a toy-train attached to the surface layer;

wherein all components of the mat-like structure are constructed of a flexible material to allow the mat-like structure to be rolled-up; and a plurality of straps connected to the mat-like structure for securing the mat-like structure in a rolled-up position.

* * * * *